United States Patent [19]

Menzel

[11] Patent Number: 4,699,183

[45] Date of Patent: Oct. 13, 1987

[54] DEVICE FOR SECURING AN EXCHANGEABLE MEMBER TO A CARRIER IN A SHUTTLELESS LOOM

[75] Inventor: Josef Menzel, Weil der Stadt, Fed. Rep. of Germany

[73] Assignee: Lindauer Dornier Gesellschaft mbH, Lindau/Bodensee, Fed. Rep. of Germany

[21] Appl. No.: 864,594

[22] Filed: May 16, 1986

[30] Foreign Application Priority Data

Jun. 1, 1985 [DE] Fed. Rep. of Germany ..... 3519685

[51] Int. Cl.[4] ..... D03D 49/00; A44B 17/00

[52] U.S. Cl. ..... 139/449; 24/453; 411/908

[58] Field of Search ..... 139/446, 449; 24/297, 24/326, 453, 458, 573; 411/908, 511

[56] References Cited

U.S. PATENT DOCUMENTS

| | | | |
|---|---|---|---|
| 3,487,859 | 1/1970 | Piccoli | 139/446 |
| 3,748,700 | 7/1973 | Willey | 24/453 |
| 4,187,590 | 2/1980 | Harris et al. | 24/453 |
| 4,485,531 | 12/1984 | Murphy | 24/453 |
| 4,524,494 | 6/1985 | Sato et al. | 24/453 |
| 4,570,684 | 2/1986 | Feigl | 139/449 |

FOREIGN PATENT DOCUMENTS

| | | |
|---|---|---|
| 805214 | 12/1958 | United Kingdom . |
| 2058990 | 9/1983 | United Kingdom . |

*Primary Examiner*—Henry S. Jaudon

*Attorney, Agent, or Firm*—W. G. Fasse; D. H. Kane, Jr.

[57] ABSTRACT

An exchangeable member is secured to a carrier in a shuttleless loom by an elastically yielding mounting element having a head, a shank, and a neck between the head and the shank. The exchangeable member has a bore aligned with a bore in the carrier. The mounting element is pulled through the bores so that the neck snaps into place in the bores under tension while the head and shank bear against outer surfaces to hold the member and carrier together. The mounting element has a nail type shape with a long shaft that is threaded through the aligned bores and pulled for tensioning the neck. The exchangeable member is, for example, a member that is subject to wear and tear that must be exchanged frequently such as the guide body of a gripper head which forms the carrier for the guide body.

12 Claims, 7 Drawing Figures

DEVICE FOR SECURING AN EXCHANGEABLE MEMBER TO A CARRIER IN A SHUTTLELESS LOOM

FIELD OF THE INVENTION

The invention relates to a device for securing an exchangeable member to a carrier in a shuttleless loom so that a worn out exchangeable member may easily be replaced by a new member. For example, the carrier may be a gripper head in the shuttleless loom and the exchangeable member may be a guide body or member in the shuttleless loom.

DESCRIPTION OF THE PRIOR ART

Many different forms of exchangeable structural components are known in shuttleless looms, especially structural components subject to wear and tear are constructed as exchangeable items. One example of such a structure is the weft thread insertion mechanism in a shuttleless loom in which each thread inserting rod carries a gripper head for gripping and transporting the weft thread through the loom shed. These gripper heads are equipped conventionally with lateral guide bodies which are guided along the reed and which have a slanted surface for sliding along the reed. Different kinds of materials can be used to make the guide bodies or members and it is known to make these guide members of wood, synthetic materials, and preferably of fiber reinforced synthetic material.

The guide bodies or members are subject to wear and tear during operation so that they must be exchanged from time to time. For this purpose it is desirable that it should not be necessary to remove from the loom the rods or flexible tapes which carry the gripper heads. As a result, the space available for exchanging the guide members is very small and not very convenient for the maintenance personnel. One possibility of securing the guide members to the gripper heads involves the use of screws. However, screws have the disadvantage that they require the insertion of tools for which the space may not be available at the gripper head, or rather near the gripper head. Further, a worn guide member can cause damage to the reed by protruding metal parts of the screwed connection. Damage to the reed or other important loom components, however, must be avoided under all circumstances.

It is also known to replace the screwed connection by an adhesive bonding. However, this type of adhesive connection also has its disadvantages. On the one hand, the strength of the adhesive bond and its reliability depends on the material of the components and on the type of adhesive and it has been found that such connections are not always reliable. On the other hand, it is difficult to separate the worn member from the rest of the component when it is time to exchange the worn member, where a good adhesive bond holds the remainder of the worn member to the respective component. Additionally, an adhesive bond requires a certain curing time which may not be desirable for the manufacturing processes and also not for a required repair because it lengthens the down time. Prolonged down times of the loom should be avoided as much as possible. In other words, the exchange of worn parts should require a minimum of time. Another point to be considered is the fact that oil saturated guide members of the gripper head provide a good self-lubrication and hence a long useful life. In fact, oil saturated guide bodies have a useful life corresponding to about three times the useful life of guide bodies which are not self-lubricated. However, oil saturated guide bodies defy an adhesive bonding.

Yet another conventional construction involves the use of mounting clips for the exchangeable guide members of the gripper head. Such clips have not been very successful, however, because the clips are expensive in their manufacture and require a very narrow tolerance in their dimension and in their elastic holding ability. If these tolerances are not met, the clips are not reliable for the intended purpose.

Another example of structural components with member subject to heavy wear are the control rails in a shuttleless loom. These control rails make sure that the clamping mechanism carried by each gripper head is properly opened and closed outside the loom shed for the transfer or release of the weft thread. These control rails also are subject to wear and tear and they serve for guiding the gripper heads. The wear and tear is especially severe when the clamping levers of the gripper heads run onto the ramp-like rail portion. Another structural component is also made to be exchangeable because it is subject to heavy wear and tear. The other structural component is located outside of the loom shed and below the control rails for the gripper heads. The other structural component forms an abutment for the withdrawn gripper head during the operation of the clamping mechanism.

All of the above mentioned considerations apply to the same extent to the guide members as far as the material, the type of securing, and the exchangeability is concerned.

OBJECTS OF THE INVENTION

In view of the foregoing it is the aim of the invention to achieve the following objects singly or in combination:

to provide a securing device which is equally useful for all the various exchangeable guide members in shuttleless looms;

to make the exchangeability as easy as possible, even where there is very little space available for the use of exchanging tools;

to make sure that the securing device does not cause any damage to the reed or to any other sensitive structural components of the loom;

to minimize down time, in other words, to make the securing device so that the repair time required for the exchange of components can be reduced to a minimum;

to construct the guide members and control rails in such a way that they can be exchanged without the need for disassembling the entire corresponding structural units, such as the gripper rods or the control mechanisms for the clamping devices; and to use an elastic securing device which can easily be removed by a sharp flat tool such as a razor blade for exchanging the respective component that is subject to wear and tear.

SUMMARY OF THE INVENTION

According to the invention the securing device especially useful in a shuttleless loom, comprises wall members, one of which is part of the exchangeable element, the other of which is part of the respective carrier. A bore passes through each wall member and the bores are in axial alignment with each other to receive a neck of an elastically expandable mounting element. The mounting element has a head of larger diameter than the bores and a shank also of a larger diameter than the bores. The neck interconnects the head and the shank and the shank can be stretched out so that it passes through the bores. The neck proper is located between two steps or shoulders which bear on the respective outer surface of the corresponding wall member. The elastic stretching of the neck applies a clamping force to the shoulders formed by the head and the shank to hold the two components together.

The elastically expandable mounting element is made of an elastomeric material such as neoprene. As the respective members are wearing out, the elastically yielding mounting elements do not pose any danger for the sensitive structural components of the loom, for example, the reed, because the elastic material does not cause any damage. Further, this type of elastically yielding mounting element is suitable for holding together components of all types of materials, including even oil soaked materials, whereby long operational lives of the structural components are assured.

Another advantage of this type of securing device is seen in that it makes possible an elastic securing of the guide member to the respective carrier, for example, the guide body to its gripper head, whereby the guide body is movable relative to its longitudinal axis to a certain extent. This feature enables the guide body to automatically adapt itself to the position of the reed so that any wear and tear on the reed itself is avoided. Further, the mounting, or rather, the securing of the guide body to the gripper head or of any other member subject to wear to its carrier is easy and quick because the elastically yielding mounting element is simply pulled through a bore by stretching it sufficiently until the neck snaps in place. Similarly, the removal of a worn element is also very simple because it is sufficient to use, for example, a knife such as a razor blade for severing the securing elements in the gap between the two elements which it holds together. Any shaft tool with a flat blade is suitable for this purpose. A special advantage resides in that the same type of elastically yielding, stretchable mounting element can be used for securing all types of elements to each other. The only requirement is, that the elements comprise wall members with a flat surface through which the needed bores may extend. This feature provides a substantial economy because the elastically yielding mounting element can now be a mass produced item that does not need to meet stringent tolerance requirements. Further advantages and features of the invention will appear from the following detailed description and from the dependent claims.

BRIEF DESCRIPTION OF THE DRAWINGS

In order that the invention may be clearly understood, it will now be described, by way of example, with reference to the accompanying drawings, wherein.

Figure 1:
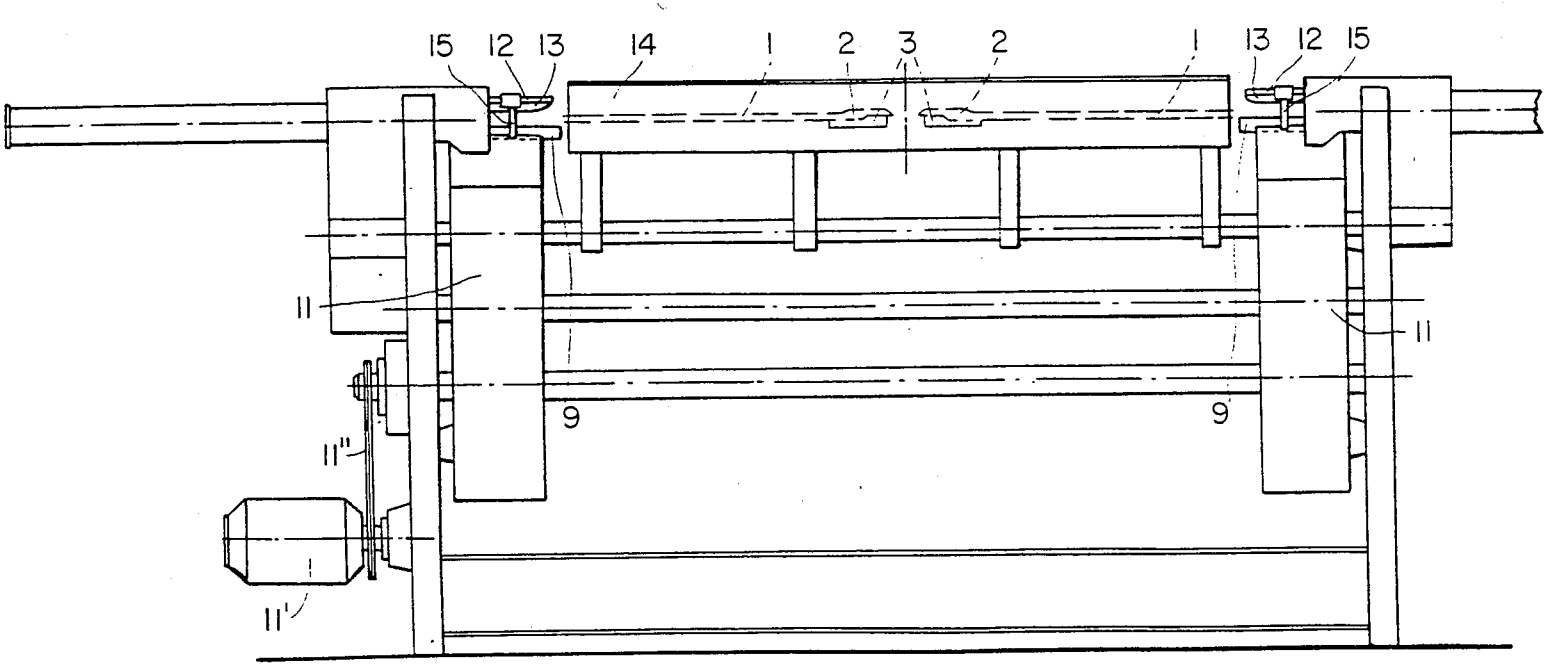
FIG. 1 is a schematic front view of a shuttleless loom in which the weft thread is moved through the loom shed by two gripper rods equipped with respective gripper heads.

DETAILED DESCRIPTION OF PREFERRED EXAMPLE EMBODIMENTS AND OF THE BEST MODE OF THE INVENTION:

FIG. 1 shows an example of the arrangement of the major components of a shuttleless loom including the exchangeable guide bodies or members 3 carried by each gripper head 2. The gripper heads 2 are carried at the free ends of gripper rods 1 which move into and out of the loom shed as is conventional. The machine frame has the usual upright side walls interconnected by cross beams and carrying a drive mechanism, including gear boxes 11, a drive motor 11', and a chain drive 11''. The drive for moving the gripper rods 1 back and forth into the loom shed is derived from the gear boxes 11 as is conventional. Therefore, further details of such drives are not described.

Figure 6:
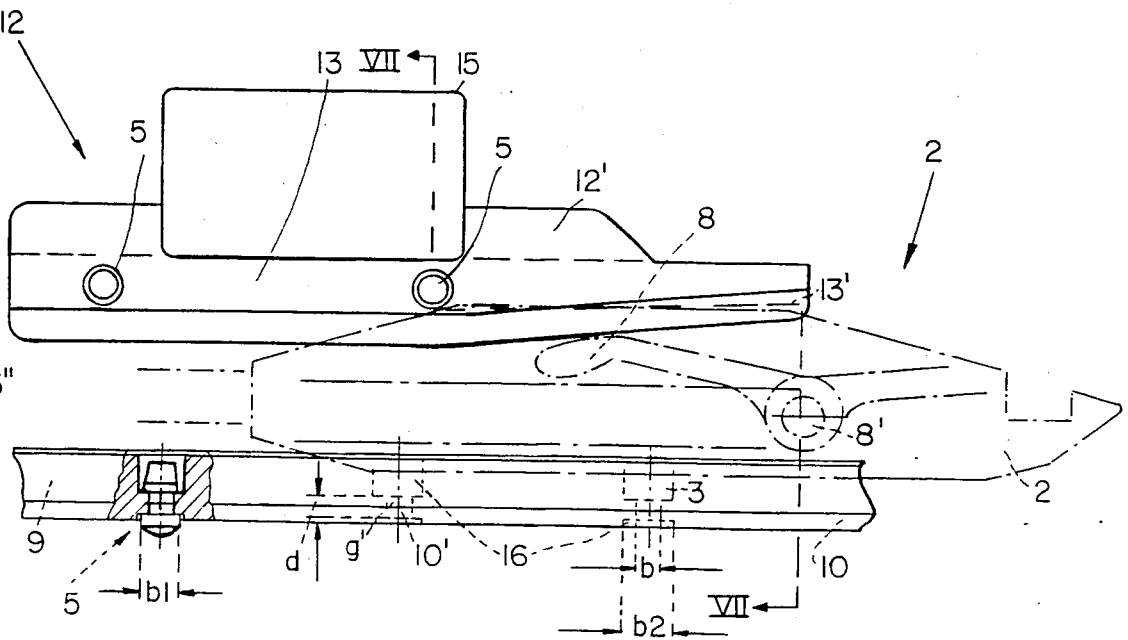
FIG. 6 is a side view of a control rail for operating the clamping mechanism of a gripper head.
Figure 7:
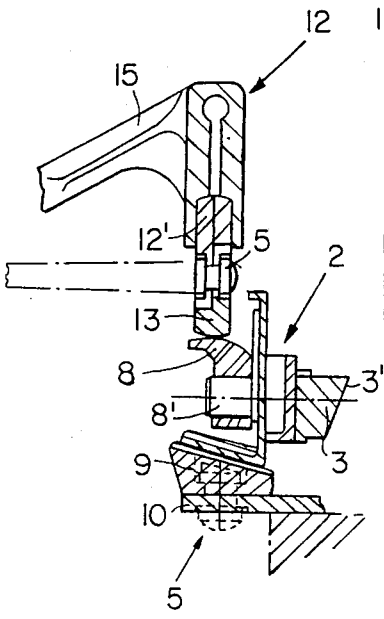
FIG. 7 is a sectional view along line VII—VII in FIG. 6.

The gripper heads 2 carried at the free ends of the gripper rods 1 are equipped with a conventional clamping mechanism shown at 8, 8' in FIGS. 6 and 7. These gripper mechanisms seize and release the weft thread as is also conventional. Each guide body or member 3 which slides back and forth along the reed 14 of the loom, is secured to its respective gripper head as will be described below. A control rail 12 for opening and closing the clamping devices of the respective gripper head is located outside of the loom shed on the right-hand side and on the left-hand side of the loom as shown in FIG. 1. These control rails 12 are located laterally next to the reed 14 and approximately above the respective gear box 11. Each control rail 12 is equipped with its own replaceable wear element in the form of a lining or cover 13 secured to the respective control rail 12 as will be described below. The control rails control the respective gripper mechanism for the seizing or releasing of the weft thread as is conventional. For this purpose, each control rail 12 or rather its lining 13 forms a ramp 13' for cooperation with the clamping lever 8 as shown in FIGS. 6 and 7. The control rails 12 with their exchangeable wear lining 13 are secured to an actuating lever 15 also shown in FIGS. 6 and 7. An intermediate mounting element 12' secures the lining or covering 13 to the control rail 12. The lever 15 is operated by power derived from the respective gear box 11 as is conventional. The lever 15 tilts the respective control rail 12 for opening and closing the corresponding gripper head 2. Alternately, the rail 12 may be arranged in a stationary position so that the clamping mechanisms of the gripper heads 2 are operated solely by engagement with the ramps 13' forming part of the lining 13 acting as a guide body.

A fixed abutment 9 is secured to the machine frame below the respective gripper head 2 as best seen in FIG. 7. A support rail 10 carries the abutment 9 which is secured to the rail 10 by a flexible, stretchable, elastically yielding mounting element 5 to be described below in more detail.

The guide member 3 of the gripper heads 2 as well as the abutment 9 on the support rail 10 and the cover or lining 13 on the control rail 12 are elements which are subject to wear and tear and are hence required to be quickly exchanged on occasion. Thus, the gripper head 2 forms a carrier for the exchangeable guide member 3. Similarly, the control rail 12 forms a carrier for the exchangeable cover or lining 13. The support rail 10 forms a carrier for the exchangeable, but otherwise fixed abutment 9. In each instance the same elastically yielding, stretchable mounting element 5 is used for the securing of the exchangeable element to its carrier as will be described in more detail below.

Figure 2:
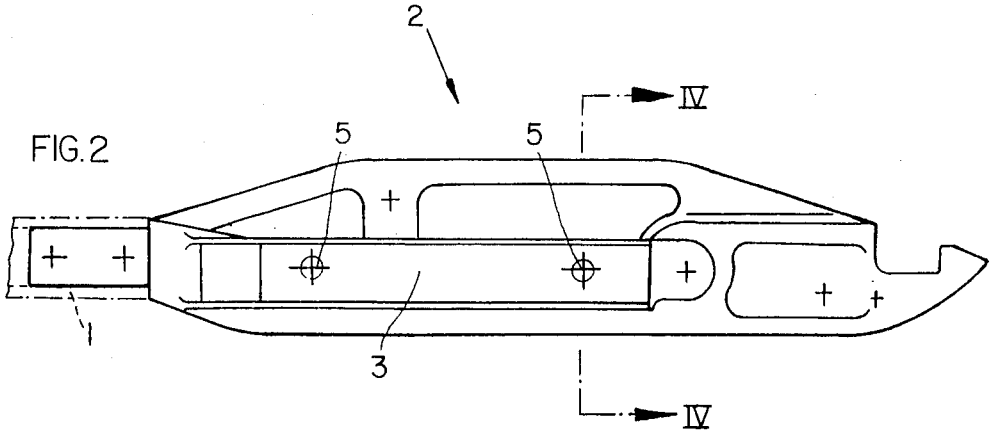
FIG. 2 illustrates a side view of a gripper head.
Figure 3:
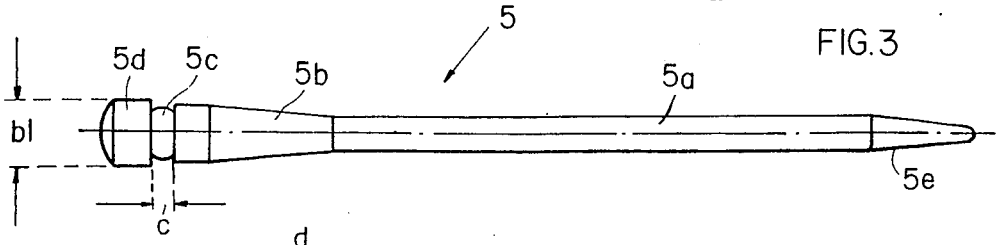
FIG. 3 illustrates the elastically yielding, stretchable mounting element according to the invention.
Figure 5:
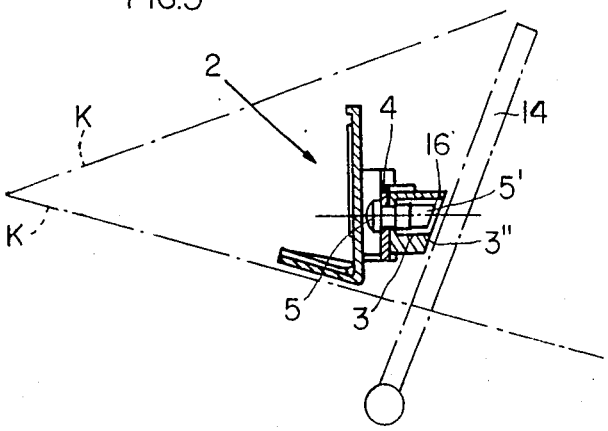
FIG. 5 is a sectional view similar to that of FIG. 4, however showing the gripper head in its position inside the loom shed to also show the reed of the loom.

FIG. 2 shows a simplified illustration of a gripper head 2 secured to a gripper rod 1 and equipped with an exchangeable guide member 3 laterally secured to the carrier formed by the gripper head 2. The guide member 3 rides along the reed 14 when the gripper head moves back and forth into the loom shed. FIG. 5 schematically illustrates the position of the gripper head 2 in the loom shed formed by the warp threads K. The guide member 3 is secured to a carrier portion 4 forming a first wall member while the rear end of the guide member 3 forms a second wall resting flat against the carrier wall 4. The connection of the guide member 3 to the carrier wall 4 is accomplished by the above mentioned elastical, stretchable mounting element 5 shown in FIG. 3. The mounting element 5 has a nail-type configuration, including a thin threading shaft 5*a* having a tip 5*e* at one end and merging into a shank 5*b* at the other end. The shank 5*b* includes, preferably, a conical section and a cylindrical section. The mounting element 5 further includes a head 5*d* and a neck 5*c* between the head 5*d* and the cylindrical portion of the shank 5*b*. The head 5*d* has a diameter b1 and forms a shoulder around the neck 5*c* of reduced diameter. The neck 5*c* has an axial length c. The cylindrical portion of the shank 5*b* also has a diameter sufficient to form a further shoulder adjacent to the neck 5*c*. The shank 5*b* does not have to have a cylindrical portion since the conical section can also form a shoulder adjacent to the neck 5*c*. The neck 5*c* is preferably formed by a groove between the head and the shank, whereby the groove has a concave bottom to provide the neck 5*c* with a convex radially outwardly facing shape. However, the neck 5*c* may also have a cylindrical configuration. As mentioned, the mounting element 5 which is simultaneously a clamping element is made of an elastical, stretchable material such as neoprene or the like.

Figure 4:
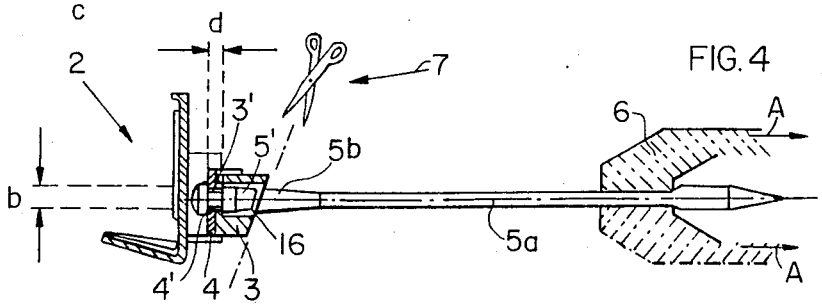
FIG. 4 is a sectional view along section line IV—IV in FIG. 2.

FIGS. 4 and 5 illustrate the securing of the guide body or member 3 to the gripper head 2 in a somewhat simplified sectional view. The wall 4 of the gripper head 2 forms a carrier and has a bore 4' in axial alignment with a second bore 3' in the bottom wall of the guide member 3. The bores 3' and 4' have a diameter b. The guide member 3 has a recess 16 with a diameter or width b2 larger than the bore diameter b to form a shoulder around the bore 3'. The bore diameter b is also smaller than the head diameter b1 to form the above mentioned shoulder facing the neck 5*c*. The bore diameter b is equal to or just slightly larger than the diameter of the neck section 5*c* of the mounting element 5.

The securing of an exchangeable member to its carrier takes place as follows. Referring, for example, to the securing of the guide member 3 to its gripper head 2, the gripper head is provided with a passage or opening opposite the bore 4' in its carrier wall 4. The mounting element 5 is inserted with its tip 5*e* through the passage, then through the bore 4' and through the bore 3' until the tip 5*e* and a portion of the shaft 5*a* protrude from the recess 16 in the guide member 3. When this partial insertion or threading is completed, a tool such as pliers 6 are used to grip the shaft 5*a* and to pull the mounting element 5 in the direction of the arrows A in FIG. 4 until the neck 5*c* comes to rest in the bores 4' and 3' which together have an axial length d. The pulling of the shaft 5*a* and of the shank 5*b* stretches the mounting element, especially its shank 5*b* sufficiently to pass through both bores 4', 3' until the shoulder formed in the head 5*d* rests against the wall 4 around the bore 4'. As soon as the cylindrical section of the shank 5*b* has passed through the bores and the pull is released, the diameter of the shank 5*b* widens again so that it snaps into place against the shoulder formed around the bore 3' in the recess 16. A tight fit is assured by making the axial length c of the neck section 5*c* a little shorter than the axial length d of the bores 3', 4', whereby the neck section 5*c* remains under axial tension, thereby tightly holding the guide member 3 to its gripper head 2. It has been found that the cylindrical section of the shank 5*b* snaps into place in an audible manner as soon as it clears the shoulder around the bore 3'. When the mounting element 5 is in place as just described, an axial pull is again applied with the tongues 6 and the portion of the mounting element 5 protruding from the recess 16 in the guide member 3 is cut off, for example, by a knife or scissors 7. When the cutting is completed, the elasticity of the remaining stub 5' makes sure to pull the stub 5' completely into the recess 16 so that the stub 5' does not protrude from the recess 16 after the cutting, please see FIGS. 4 and 5.

As shown in FIG. 5 the gripper head 2 slides with the slanted surface 3'' of its guide member 3 along the reed 14 through the loom shed formed by the warp threads K. The reed 14 is shown in dashdotted lines in FIG. 5. Since the stub 5' is completely drawn into the recess 16, the stub 5' does not interfere with the back and forth movement of the gripper head 2 along the reed 14 in the loom shed. Accordingly, the stub 5' cannot cause any damage to the reed 14.

Further, due to the elasticity of the mounting element 5, its neck 5*c* expands radially when the pull is released so that it bears against the surfaces of the bores 4', 3', thereby also assuring a tight fit of the mounting element in the bores 3', 4' to tightly hold the guide member 3 in place. Depending on the axial length d of the bores 3' and 4' and on the axial length c of the neck 5*c* and further depending on the elasticity of the material used for making the mounting elements 5, a very tight fit may be achieved or a slightly elastic yielding of the connection between the carrier wall 4 and the guide member 3 may be obtained. The removal of the connection is easily accomplished by inserting a flat cutting blade, such as a razor blade, between the carrier wall 4 and the end wall of the guide member 3 for severing the neck 5*c*. A new mounting element is then used for securing a new guide member.

FIGS. 6 and 7 illustrate two further examples for the use of the mounting elements 5. The control rail 12 conventionally connected to the actuating lever 15 has attached thereto, a carrier wall member 12' provided with a bore and a recess. Similarly, the lining or cover 13 is provided with a bore and a recess as seen in FIG. 7. The lining or covering 13 is subject to wear and tear, especially in its ramp section 13', where it cooperates with the clamping lever 8 which is tiltably mounted on a journal axis 8' for opening and closing the gripper mechanism not shown in detail since it is not part of the invention. The mounting element 5 secures, or a plurality of such mounting elements secure the lining 13 to the carrier wall 12′ in the same manner as has been described above with regard to the elements 3 and 4.

The gripper head 2 has a lower slanted leg which rides on a fixed abutment 9 secured by an elastic mounting element 5 to a support rail 10 which in turn is conventionally connected to the machine frame. The operation of the gripping mechanism is conventional and can either be performed by a tilting movement of the actuating lever 15 or by the passing of the lever 8 along the ramp 13′. The invention is not concerned with the opening and closing of the gripper mechanism.

The abutment 9 is provided with a bore 9′ and the support rail 10 is provided with a bore 10′ which are in axial alignment with each other as shown in FIGS. 6 and 7. Again, it is preferable to provide the recess 16 so that the stub of the connecting elements may pull itself into such recess so as not to interfere with the sliding movement of the lower leg of the gripper head 2 along the abutment 9.

Other components may be connected by the elastic mounting element 5. It has been found that the elastic strength of these mounting elements is sufficient to even form a form-locking connection which is simple and safe while simultaneously it can be rapidly accomplished as long as two flat wall members face each other to permit the above mentioned bores to pass through the two flat wall members in axial alignment. Another advantage of the present connecting device is seen in that the connecting or mounting elements have a noise damping effect due to their elasticity.

Although the invention has been described with reference to specific example embodiments, it will be appreciated, that it is intended to cover all modifications and equivalents within the scope of the appended claims.

What I claim is:

1. A device for securing an exchangeable means to a carrier in a shuttleless loom, comprising a first wall member forming part of said exchangeable means, a second wall member forming part of said carrier, said first and second wall members having surfaces contacting each other, a first bore passing through said first wall member, a second bore passing through said second wall member in axial alignment with said first bore, said bores having a given first diameter, said bores having together a first axial length, an elastically yielding mounting element having a head, a shank, and a neck between said shank and said head, said shank having normally a diameter larger than said given bore diameter and an elasticity for sufficiently reducing said normal shank diameter to fit through said first and second bores by pulling and stretching said shank through said bores having said given bore diameter, said neck having a second axial length which is normally less than said first axial length of said bores for sitting in said first and second bores with an axially effective contraction stress pressing said first and second wall members toward each other, said head having a shoulder resting flat against one of said wall members, said shank having a further shoulder resting flat against the other of said wall members for interconnecting said first and second wall members to each other with said axially effective contraction stress.

2. The device of claim 1, wherein said first wall member has a first recess opposite its contacting surface around said first bore in said first wall member, said second wall member having a second recess opposite its contacting surface around said second bore in said second wall member, each recess forming a respective shoulder around its bore, said head sitting at least partially in one of said recesses, said shank sitting in the other of said recesses.

3. The device of claim 1, wherein said elastically yielding mounting element comprises a nail shape including a shaft (5*a*) merging into said shank, said shaft having a diameter for passing through said first and second bores and for said pulling of said shank located between said shaft and said neck through said bores.

4. The device of claim 1, wherein said carrier is a support rail (10) for a gripper head in said shuttleless loom, and wherein said exchangeable means is an exchangeable abutment (9) secured to said support rail (10) by said elastically yielding mounting element (5).

5. The device of claim 1, further comprising a circumferential groove in said elastic mounting element between said head and said shank, whereby said neck is formed in said elastic mounting element.

6. The device of claim 1, wherein said neck has an outwardly bulging bead configuration for facilitating the stretching of said neck in its mounted position.

7. The device of claim 1, wherein said carrier is a gripper head (2) in said shuttleless loom, and wherein said exchangeable means is a replaceable guide member (3) secured to said gripper head (2) by said elastically yielding mounting element (5).

8. The device of claim 1, wherein said carrier is a guide rail (12) for a gripper head in said shuttleless loom, and wherein said exchangeable means is an exchangeable lining (13) secured to said guide rail (12) by said elastically yielding mounting element (5).

9. A device for securing at least two elements having flat surfaces to each other, said elements having aligned through holes with a given diameter and with a given first axial length through both holes, comprising an elastically yielding mounting element having a head with a head shoulder for contacting one of said flat surfaces, a shank with a shank shoulder for contacting the other flat surface, and a neck between said shoulders of said shank and of said head, said shank having normally a diameter larger than said given through hole diameter and an elasticity for sufficiently reducing said normal shank diameter to fit through said aligned holes by pulling and stretching said shank through said holes having said given hole diameter, said neck having a second axial length normally less than said first axial length of said holes for sitting in said holes with an axially effective contraction stress, said head shoulder pressing against one of said flat elements, said shank shoulder pressing against the other of said flat elements for interconnecting said flat elements to each other with said axially effective contraction stress exerted by said neck when the neck is stretched in said holes.

10. The device of claim 9, wherein said elastically yielding mounting element has a nail shape including a shaft (5*a*) merging into said shank, said shaft having a diameter for passing through said through holes, said shank being located between said shaft and said neck.

11. The device of claim 9, further comprising a circumferential groove in said elastic mounting element between said head and said shank, whereby said neck is formed in said elastic mounting element.

12. The device of claim 9, wherein said neck has an outwardly bulging bead configuration for facilitating the stretching of said neck in its mounted position.

* * * * *